United States Patent [19]

Kwok

[11] 4,015,779

[45] Apr. 5, 1977

[54] FLUID OSCILLATOR AND PULSATING SHOWER HEAD EMPLOYING SAME

[75] Inventor: Clyde C. K. Kwok, Montréal, Canada

[73] Assignee: E. V. Rippingille, Jr., Key Largo, Fla.

[22] Filed: Oct. 9, 1975

[21] Appl. No.: 621,257

[30] Foreign Application Priority Data

Sept. 19, 1975 Canada ..... 235925

[52] U.S. Cl. ..... 239/102; 239/DIG. 3

[51] Int. Cl.[2] ..... B05B 3/14

[58] Field of Search ..... 239/101, 102, 89, 96, 239/DIG. 3; 137/624.14; 222/335

[56] References Cited

UNITED STATES PATENTS

| | | | |
|---|---|---|---|
| 2,947,323 | 8/1960 | Becker | 137/624.14 |
| 3,353,712 | 11/1967 | Prescott | 222/335 X |
| 3,902,664 | 9/1975 | Deines | 239/102 |
| 3,920,185 | 11/1975 | Kwok | 239/102 |

*Primary Examiner*—Johnny D. Cherry
*Assistant Examiner*—Michael Mar
*Attorney, Agent, or Firm*—Rogers, Bereskin & Parr

[57] ABSTRACT

A fluid oscillator for producing pulsations in a flow of fluid, having a housing with a fluid inlet channel for connection to a supply of fluid under pressure, a fluid outlet channel, and a diaphragm valve which alternatively opens and closes causing intermittent flow of fluid from the fluid inlet channel to the fluid outlet channel. The valve opens due to the fluid supply pressure in the fluid inlet channel and the valve closes due to a reduction in pressure caused by the inertia of the fluid in the fluid outlet channel. A pressure accumulator is located adjacent to the inlet channel to absorb fluctuations in fluid pressure in the inlet channel. An elastic separator element is located in the housing to define a gaseous compartment in the pressure accumulator, so that pressure fluctuations in the fluid inlet channel are generally absorbed or attenuated by compression and expansion of the gas in the accumulator.

10 Claims, 3 Drawing Figures

FLUID OSCILLATOR AND PULSATING SHOWER HEAD EMPLOYING SAME

This invention relates to a fluid oscillator for producing periodic pulsations in fluid flow, and in particular to a pulsating shower head employing same. More specifically, the invention relates to a fluid oscillator which has a pressure accumulator for absorbing major fluctuations in fluid pressure caused by the periodic interuption of fluid flow through the oscillator.

In the past, fluid oscillators have been made for producing pulsations in fluid flow. These oscillators typically have some type of valve, which may be a mechanically actuated device, thus periodically interrupts the flow of fluid through the oscillator. A difficulty with the devices used in the past is that the interruption in the fluid flow is normally very abrupt resulting in the production of strong pressure waves in the fluid. These pressure waves propagate upstream through the fluid supply line and create an undesirable "water-hammer" effect in the plumbing forming the fluid supply line to the oscillator. In addition, the mechanical type valves are generally unreliable and often result in undesirable leakage caused by wide manufacturing tolerances or by excessive wear in moving valve parts.

The present invention reduces the water-hammer effect by having a pressure accumulator located adjacent to the fluid inlet channel to absorb or attenuate pressure waves or fluctuations in pressure in the fluid inlet channel.

A fluid oscillator according to the present invention includes a housing having a fluid inlet channel for connection to a supply of fluid under pressure, and a fluid outlet channel for flow of fluid through the housing. Valve means located between the inlet and outlet channels controls fluid flow from the inlet to the outlet channel. The valve means is adapted to open by fluid pressure in the inlet channel and is adapted to close by a reduction in fluid pressure in the outlet channel. The valve means includes means for biasing the valve means toward a closed position. The outlet channel is dimensioned to produce a reduction in fluid pressure therein after the valve means reaches a fully open position, so that the valve means commences to close. A pressure accumulator is located adjacent to the inlet channel to attenuate fluctuations in fluid pressure in the inlet channel. Also, an elastic separator element is located in the housing to define a sealed gaseous compartment in the pressure accumulator, so that pressure fluctuations in the inlet channel are generally absorbed by compression and expansion of the gas in the accumulator.

A preferred embodiment of the invention will now be described by way of example, with reference to the accompanying drawings in which.

Figure 1:
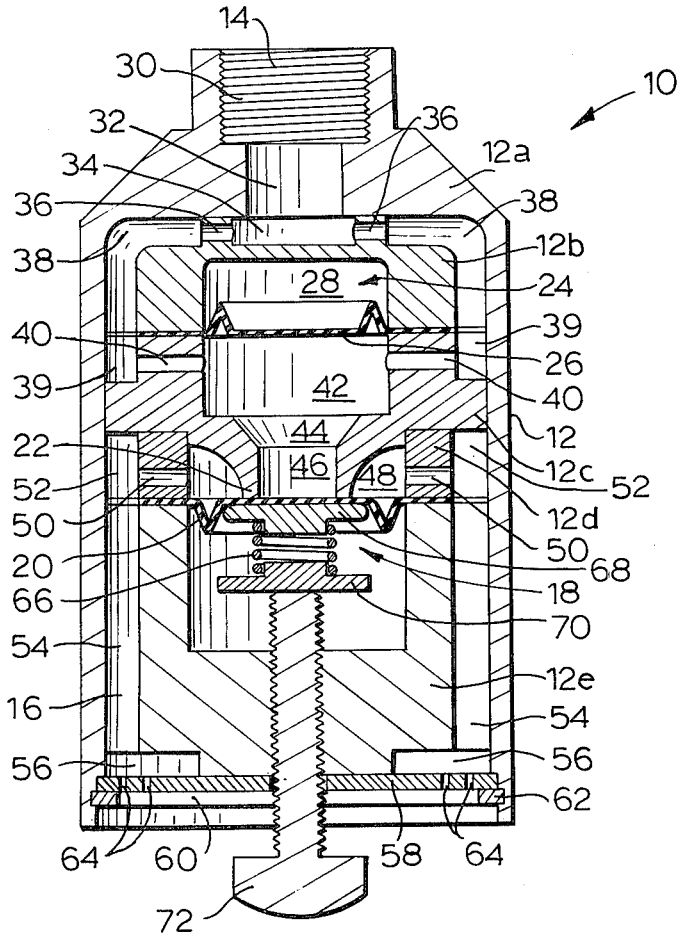
FIG. 1 is a sectional view of a preferred embodiment of a pulsating shower head employing a fluid oscillator according to the invention.

In the following description of the preferred embodiments of the invention, like reference numerals will be used to indicate similar parts throughout, primed reference numerals being used to refer to the embodiment shown in FIGS. 2 and 3.

Referring firstly to FIG. 1, a fluid oscillator as employed in a pulsating shower head is generally indicated by reference numeral 10. Oscillator 10 includes a housing 12 having a fluid inlet channel 14 for connection to a supply of fluid under pressure and a fluid outlet channel 16 for flow of fluid through housing 12 and out of oscillator 10. A valve assembly 18 is located between the inlet and outlet channels 14, 16 for controlling fluid flow from the inlet channel 14 to the outlet channel 16. The valve assembly includes a diaphragm 20 which is held against an annular valve seat 22 when the valve assembly 18 is in the closed position. Fluid under pressure entering inlet channel 14 causes diaphragm 20 to move away from valve seat 22 resulting in valve assembly 18 opening and fluid flowing through outlet channel 16. When the valve assembly 18 is fully open, a reduction in fluid pressure is created in outlet channel 16 as will be described more fully below, and valve assembly 18 then closes to interrupt the flow of fluid through oscillator 10. A pressure accumulator 24 is located adjacent to inlet channel 14 to attenuate fluctuations in fluid pressure in the inlet channel caused by the closing of valve assembly 18. An elastic separater element 26 in the form of a second diaphragm is located in the housing to define a sealed gaseous compartment 28 in pressure accumulator 24, so that pressure fluctuations in inlet channel 14 are generally absorbed or attenuated by compression and expansion of the gas in the gaseous compartment 28 of accumulator 24.

Referring in more detail to the construction of oscillator 10, housing 12 includes an outer portion **12*a* and four inner portions 12*b*, 12*c*, 12*d* and 12*e* positioned in respective order from top to bottom of oscillator 10. All of the housing portions 12*a* to 12*e* are generally cylindrical in shape with various openings being formed therein to define the various fluid flow passages in oscillator 10. In particular, fluid inlet channel 14 is defined by: axial bores 30, 32 in outer portion 12*a;* axial bore 34, transverse bores 36 and elongated peripheral grooves 38 in inner portion 12*b;* and peripheral grooves 39, transverse bores 40 and axial bores 42, 44 and 46 in inner portion 12*c*. Fluid outlet channel 16 is formed by: annular opening 48, transverse bores 50 and longitudinal peripheral groove 52 formed in inner portion 12*d;* and elongated peripheral grooves 54 and annular opening 56 formed in inner portion 12*e*.**

All of the inner portions **12*b* to 12*e* are slidingly located inside outer portion 12*a* and are held in position by a distributor plate 58 which is in turn held in position by a spring loaded retaining ring 60 located in an inner groove in outer portion 12*a*. Means are provided (not shown) such as screws or mating ribs and grooves for preventing the inner portions 12*b* to 12*e* from rotating so that the various fluid passages remain in communicating alignment when oscillator 10 is assembled. Distributor plate 58 is formed with concentric rings of spaced apart openings 64 which form shower jets and which are also part of the fluid outlet channel 16.**

Valve assembly 18 includes a spring 66 which biases the valve toward a closed position. Spring 66 is located between an upper bearing plate 68 and a lower guide plate 70. Guide plate 70 is connected to a threaded adjusting screw 72 which may be turned to vary the compression of spring 66 and thus the amount of bias provided by spring 66. Bearing plate 68 is generally flat so that diaphragm 20 seats firmly against annular valve seat 22 to prevent fluid flow through oscillator 10.

Figure 2:
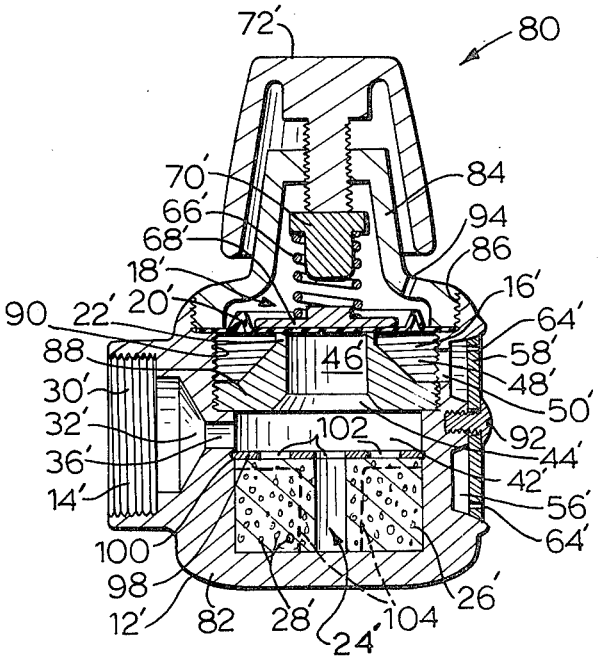
FIG. 2 is a sectional view of another embodiment of a pulsating shower head employing a fluid oscillator according to the invention, FIG. 2 being taken along lines 2—2 of FIG. 3.
Figure 3:
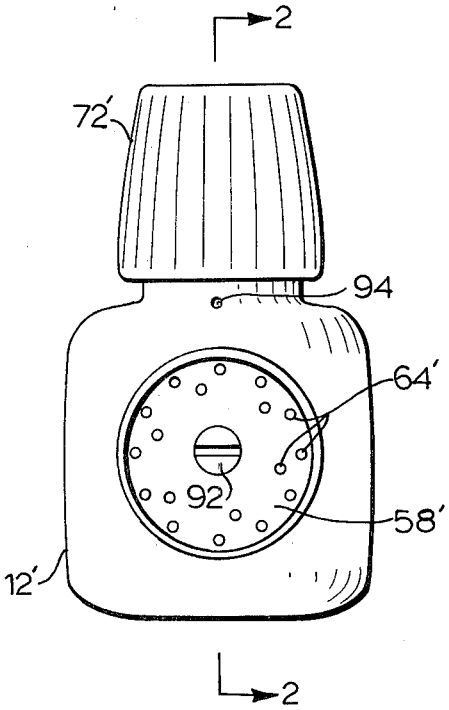
FIG. 3 is a side view of the embodiment shown in FIG. 2.

The embodiment of the fluid oscillator shown in FIGS. 2 and 3 is generally indicated by a reference numeral 80. The construction of oscillator 80 is somewhat similar to that of oscillator 10, however housing 12' now includes a main body portion 82, an upper portion 84 screwed into an upper axial threaded opening 86 in main portion 82, and a central portion 88 screwed into a second axial threaded opening 90 in main portion 82. Distributor plate 58' is attached to housing 12' by a screw 92 rather than a retaining ring. A vent hole 94 is provided in upper portion 84 to facilitate axial movement of diaphragm 20' (a similar vent hole is not shown but could be provided in oscillator 10). Finally, elastic separator (diaphragm) 26 in oscillator 10 has been replaced by an annular shaped section of elastic deformable material 26' such as foam rubber or suitable resilient plastic material. Elastic separator 26' has a plurality of sealed air pockets forming sealed gaseous compartment 28' which perform a function similar to sealed gaseous compartment 28 in oscillator 10. Elastic separator 26' is held in position by a flexible spacer plate 98 loacted in a mating peripheral inner groove 100 in housing 12'. Spacer plate 98 is formed with a plurality of openings 102 which permit fluid to pass therethrough to compress elastic separator 26' into the shape indicated by dotted lines 104.

Oscillators 10, 80 are typically made of suitable plastic material which is capable of withstanding the pressure of fluid entering fluid inlet channels 14, 14'. Diaphragms 20, 20' and 26 are formed of suitable elastic or rubberlike material to permit axial or transverse deflection of the diaphragms.

The operation of oscillators 10, 80 will now be described with reference to FIG. 1 except where the operation of oscillator 80 is different than oscillator 10, in which case primed reference numerals will refer to FIGS. 2 and 3. Fluid under pressure enters fluid inlet channel 14 and it passes through the various flow passages forming inlet channel 14 until the fluid reaches valve assembly 18. Fluid pressure then builds up in inlet channel 14 causing elastic separator 26 to deflect upwardly (or to be compressed in the case of elastic separator 26') thereby compressing the gas in sealed gaseous compartment 28 (or gaseous compartment 28' in oscillator 80). This causes the pressure in pressure accumulator 24 to increase so that it is almost equal to the pressure of the fluid supply. As the pressure of the fluid supply in inlet channel 14 increases, the fluid pressure in axial bore 46 acting on diaphragm 20 causes the valve assembly 18 to open to permit fluid to flow into the fluid outlet channel 16 and out through openings or shower jets 64. It will be appreciated that when valve assembly 18 opens, the gas in gaseous compartment 28 expands resulting in a positive downward displacement of the elastic separator 26 which in turn provides an additional push to the water passing through valve assembly 18. As the valve assembly 18 approaches the fully open position, the rate of fluid flowing past annular valve seat 22 into fluid outlet channel 16 increases. When valve assembly 18 reaches the fully open position this fluid flow rate still increases slightly due to the resistance to fluid flow caused by the inertia of the fluid and the flow losses in the fluid outlet channel. This increase in flow after valve assembly 18 reaches the open position causes a decrease in static pressure between valve seat 22 and diaphragm 20, which in turn causes diaphragm 20 to commence to close. As diaphragm 20 commences to close, the fluid flow rate in outlet channel 16 decreases, but the inertia of the fluid flowing in the outlet channel tends to resist the decrease in flow. The result is a further decrease in pressure caused by this "inertia effect" in the fluid outlet channel. This further decrease in pressure causes diaphragm 20 to snap closed and abruptly stop the fluid flow in outlet channel 16. The inertia of the fluid flowing in outlet channel 16 when valve assembly 18 closes causes a momentary partial vacuum in outlet channel 16 to firmly hold the valve assembly in the closed position. After a predetermined interval, which depends primarily on the volume of the fluid outlet channel, the partial vacuum is substantially dissipated and the pressure in the fluid inlet channel again causes the valve to commence to open.

When the diaphragm valve assembly 18 snaps closed, a pressure wave or momentary increase in pressure is produced that tends to propagate upstream to the fluid supply line producing an undesirable water-hammer in the supply piping. However, pressure accumulator 24 effectively absorbs or attenuates most of this pressure wave through compression of the gas in sealed gaseous compartment 28, so that any water-hammer resulting from the operation of oscillators 10, 80 is relatively insignificant.

The frequency of oscillation or of the flow pulses produced by oscillators 10, 80 depends primarily on the pressure of the fluid supply and the dimensions of the fluid passages in the oscillator. However, the frequency of oscillation may be varied by turning adjusting screw 72 which varies the compression of spring 66. Spring 66 exerts a force on diaphragm 20 to help close valve assembly 18, and therefor a higher force exerted by spring 66 will cause valve assembly 18 to close faster. Adjusting screw 72 may also be used to compensate for variations in fluid supply pressure which normally would change the frequency of oscillation of fluid oscillators 10, 80. The frequency of oscillation of oscillators 10, 80 may also be changed by varying the dimensions of fluid outlet channel 16. Enlarging this channel to increase the inertia of the fluid flowing therethrough normally increases the length of time during which the partial vacuum exists in outlet channel 16 when valve assembly 18 closes. An increase in the duration of this partial vacuum would decrease the frequency of oscillation.

The dimensions of the flow restrictions in fluid inlet channel 14, such as transverse bores 36, 36', are such that the flow resistance in the inlet channel is less than the flow resistance in the outlet channel, caused by such passages as transverse bores 50, 50' and shower jets 64, 64'. This ensures that the flow rate in outlet channel 16 will increase after the valve assembly 18 reaches the fully open position so that the valve assembly 18 will commence to close as discussed above. The restrictions 36, 40 in the fluid inlet channel also help to prevent pressure waves from propagating upstream to produce water-hammer.

Having described preferred embodiments of the invention, it will be appreciated that variations or modifications may be made in the structure shown. For example, the pressure accumulator 24 may be any device that provides a sealed gaseous compartment that may be compressed by the fluid in fluid inlet channel 14. Any gas could be used in the gaseous compartment or a combination of gases and other fluids could be used, provided the fluid is compressible so that it absorbs pressure waves produced by the rapid closing of the valve assembly 18.

It may be desirable to include suitable seals, such as o-rings, between the various housing elements, especially if high fluid supply pressures are encountered. These seals would also permit wider tolerance variations during the manufacture of the components of the fluid oscillators.

If desired, adjusting screw 72 could be eliminated, in which case the initial tension of spring 66 would be adjusted or set during assembly of the fluid oscillator. This type of fluid oscillator would work satisfactorily provided the pressure of the fluid supply did not fluctuate widely, otherwise the oscillator may oscillate too fast or too slow.

It will be appreciated that the fluid oscillator of the present invention may be used in other applications than shower heads. For example, the oscillator may be used in dental hygienic devices or any other device requiring a pulsating fluid flow.

Finally, the fluid which the shower head of the present invention is intended to operate with is water. However, any fluid of sufficient density to achieve the required inertia or pressure reduction effect in the fluid outlet channel must be used. In particular, the fluid oscillator of the present invention is intended to operate at relatively low frequencies and to produce pulsations in the flow of liquid, such as water.

What I claim is:

1. A fluid oscillator for producing pulsations in a flow of fluid comprising:

a. a housing having a fluid inlet channel for connection to a supply of fluid under pressure, and a fluid outlet channel for flow of fluid through the housing;

b. valve means located between the inlet and outlet channels for controlling fluid flow from the inlet to the outlet channel, the valve means being adapted to open by fluid pressure in the inlet channel and adapted to close by a reduction in fluid pressure in the outlet channel, the valve means including means for biassing the valve means toward a closed position;

c. the outlet channel being dimensioned to produce a reduction in fluid pressure therein after the valve means reached a fully open position, so that the valve means commences to close;

d. a pressure accumulator located adjacent to the inlet channel to attenuate fluctuations in fluid pressure in the inlet channel; and e. an elastic separator element located in the housing to define a sealed gaseous compartment in the pressure accumulator, so that pressure fluctuations in the inlet channel are generally absorbed by compression and expansion of the gas in the accumulator.

2. A fluid oscillator as claimed in claim 1 wherein said elastic separator element is a diaphragm spaced between the fluid inlet channel and the pressure accumulator, the diaphragm being adapted to seal said gaseous compartment to prevent gas escaping therefrom.

3. A fluid oscillator as claimed in claim 1 wherein said elastic separator element is formed of elastic deformable material defining said sealed gaseous compartment, said element being located in the pressure accumulator so that fluid pressure in the fluid inlet channel deforms said element and said gaseous compartment therein.

4. A fluid oscillator as claimed in claim 3 wherein said elastic separator element is formed of foam rubber, so that said element defines a plurality of sealed gaseous compartments.

5. A fluid oscillator as claimed in claim 1 wherein the fluid inlet channel and the fluid outlet channel are dimensioned so that the flow restrictions in the fluid inlet channel are greater than the flow restrictions in the fluid outlet channel.

6. A fluid oscillator as claimed in claim 1 wherein said valve means includes an annular valve seat and a diaphragm located across the valve seat, the diaphragm being moveable so that when the valve means is in the open position the diaphragm is spaced from the valve seat to permit fluid flow from the fluid inlet channel to the fluid outlet channel, and so that when the valve means is in the closed position the diaphragm is positioned against the valve seat to prevent fluid flow from the fluid inlet channel to the fluid outlet channel.

7. A fluid oscillator as claimed in claim 6 wherein said valve bias means is a spring adapted to urge said diaphragm against said valve seat.

8. A fluid oscillator as claimed in claim 7 and further comprising means for adjusting the force exerted by the spring against the diaphragm.

9. A pulsating shower head comprising:

a. a housing having a fluid inlet channel for connection to a supply of fluid under pressure, and a fluid outlet channel for flow of fluid through the housing;

b. valve means located between the inlet and outlet channels for controlling fluid flow from the inlet to the outlet channel, the valve means being adapted to open by fluid pressure in the inlet channel and adapted to close by a reduction in fluid pressure in the outlet channel, the valve means including means for biassing the valve means toward a closed position;

c. the outlet channel being dimensioned so that the inertia of the fluid flowing therethrough causes a reduction in fluid pressure therein after the valve means reaches a fully open position, thereby causing the valve means to commence to close;

d. the housing defining a plurality of openings in the fluid outlet channel to form a plurality of shower jets when fluid flows through the fluid outlet channel;

e. a pressure accumulator located adjacent to the inlet channel to attenuate fluctuations in fluid pressure in the inlet channel; and f. an elastic separator element located in the housing to define a sealed gaseous compartment in the pressure accumulator, so that pressure fluctuations in the inlet channel are attenuated by compression and expansion of the gas in the accumulator.

10. A pulsating shower head as claimed in claim 9 wherein said elastic separator element is in the form of an elastic deformable element located in the pressure accumulator in contact with the fluid in the fluid inlet channel, said elastic deformable element defining at least one sealed gaseous compartment located therein.

* * * * *